United States Patent [19]

Klein

[11] 4,101,108

[45] Jul. 18, 1978

[54] SHELF CLIP

[75] Inventor: Thomas A. Klein, Plainwell, Mich.

[73] Assignee: Lear Siegler, Inc., Kalamazoo, Mich.

[21] Appl. No.: 803,711

[22] Filed: Jun. 6, 1977

[51] Int. Cl.[2] ..... A47G 29/02

[52] U.S. Cl. ..... 248/243; 248/301; 248/221.2

[58] Field of Search ..... 248/243, 244, 245, 246, 248/301, 339, 221.2; 211/187, 190, 191, 192; 108/107, 114

[56] References Cited

U.S. PATENT DOCUMENTS

| | | | |
|---|---|---|---|
| 3,522,920 | 8/1970 | Gray et al. | 108/107 |
| 4,013,022 | 3/1977 | Walter et al. | 248/243 |

FOREIGN PATENT DOCUMENTS

| | | | |
|---|---|---|---|
| 15,757 | 1/1912 | France | 248/243 |
| 2,146,003 | 3/1972 | Fed. Rep. of Germany | 248/243 |
| 1,093,258 | 11/1967 | United Kingdom | 248/243 |
| 1,279,494 | 6/1972 | United Kingdom | 248/243 |

*Primary Examiner*—Robert A. Hafer

*Attorney, Agent, or Firm*—Reising, Ethington, Barnard, Perry & Brooks

[57] ABSTRACT

A shelf clip of a unitary metallic construction for securely positioning a shelf on a shelving unit and usable in a back-to-back relationship with a like clip in an interfitted relationship. Upper and lower ends on an attachment flange of a body of the clip include a support hook and a downwardly extending positioning tang located on one side of a lateral center between the attachment flange sides so as to permit the interfitted relationship of the clips in their back-to-back relationship. A support flange extends horizontally from the lower end of the attachment flange with the positioning tang struck therefrom and includes an end that projects upwardly in a slightly inclined orientation. Cooperation between a dimple formed in the attachment flange and the inclined support flange end securely positions the shelf with respect to the clip while cooperation of the support hook and the positioning tang positions the clip with respect to the shelving unit.

5 Claims, 7 Drawing Figures

SHELF CLIP

BACKGROUND OF THE INVENTION

1. Field of the Invention

This invention relates to a clip for positioning a shelf on a shelving unit.

2. Description of the Prior Art

Clips for positioning shelves in an adjustable manner on a shelving unit are well known and have found wide usage in industrial, commercial, and household applications. Vertical adjustment of the clip location upon securement to apertured columns of the shelving unit permits the shelf to be vertically positioned at the desired location. However, upon such positioning, it is desirable for the clip to be securely positioned with respect to the shelving unit and for the shelf to be securely positioned with respect to the clip.

Prior shelf clips have included upper and lower attachment hooks for securing the clip with respect to the shelving unit. See for example U.S. Pat. Nos. 754,817; 1,375,855; 1,473,817; 1,504,523; and 2,896,794. Also, U.S. Pat. No. 2,909,289 discloses a hold down clip that is cooperable with the shelf clip in order to secure the shelf with resepct to the clip against upward movement.

SUMMARY OF THE INVENTION

An object of the present invention is to provide an improved shelf clip that may be used in a back-to-back interfitted relationship with a like shelf clip to securely position a shelf with respect to a shelving unit.

In carrying out the above object, the shelf clip of this invention includes an attachment flange with upper and lower ends secured to a shelving unit column by an upper hook and a lower positioning tang. In order to permit the clip to be interfitted with another like clip in a back-to-back relationship, both the hook and the positioning tang are located to one side or the other of a center between the opposite lateral sides of the attachment flange. A support flange extends horizontally from the attachment flange to support a shelf end with respect to the clip. Both the upper hook and the lower positioning tang extend horizontally in the opposite direction as the support flange to permit securement thereof with respect to the shelving unit column.

A unitary metallic clip body defines the clip attachment and support flanges as well as the upper support hook and the lower positioning tang. During a stamping operation forming the clip, the positioning tang is struck from the shelf support flange. In its final configuration, the positioning tang has an inclined portion that extends downwardly and horizontally away from the attachment flange in the opposite direction as the support flange and also includes an end that projects downwardly from the inclined portion. Alignment of the lower positioning tang end and the upper hook of the attachment flange on the same side of the attachment flange center between its sides gives the clip stability in supporting the shelf end. Secure positioning of the shelf end with respect to the clip is achieved by an upwardly bent end of the support flange and a cooperable dimple in the attachment flange. In bending the support flange end upwardly, a slight angular inclination away from the attachment flange is provided and the dimple projects from the attachment flange toward the support flange end in the same horizontal direction so that a flanged shelf end can be wedged therebetween in order to provide the shelf securement. Both the support hook and the positioning tang have curved lower ends that extend away from the attachment flange to aid in installation of the clip.

In its most preferred form, the attachment flange has a width of about one and three-eights inches and a height of about one and one-quarter inches. The support flange projects outwardly from the attachment flange in a horizontal direction for about three-quarters of an inch and its upwardly projecting end has a height of about one-half inch. Locating the dimple just slightly above the vertical center point of the attachment flange height provides good securement of the flanged shelf end in cooperation with the support flange end. Both the upper hook and the lower positioning tang extend horizontally from the attachment flange in the opposite direction as the support flange approximately three-sixteenths of an inch, and have a width of about one-quarter inch, while the upper hook extends downwardly about one-quarter of an inch and the positioning tang extends downwardly about three-quarters of an inch.

The objects, features and advantages of the present invention are readily apparent from the following detailed description of the preferred embodiment taken in connection with the accompanying drawings.

DETAILED DESCRIPTION OF THE PREFERRED EMBODIMENT

Figure 1:
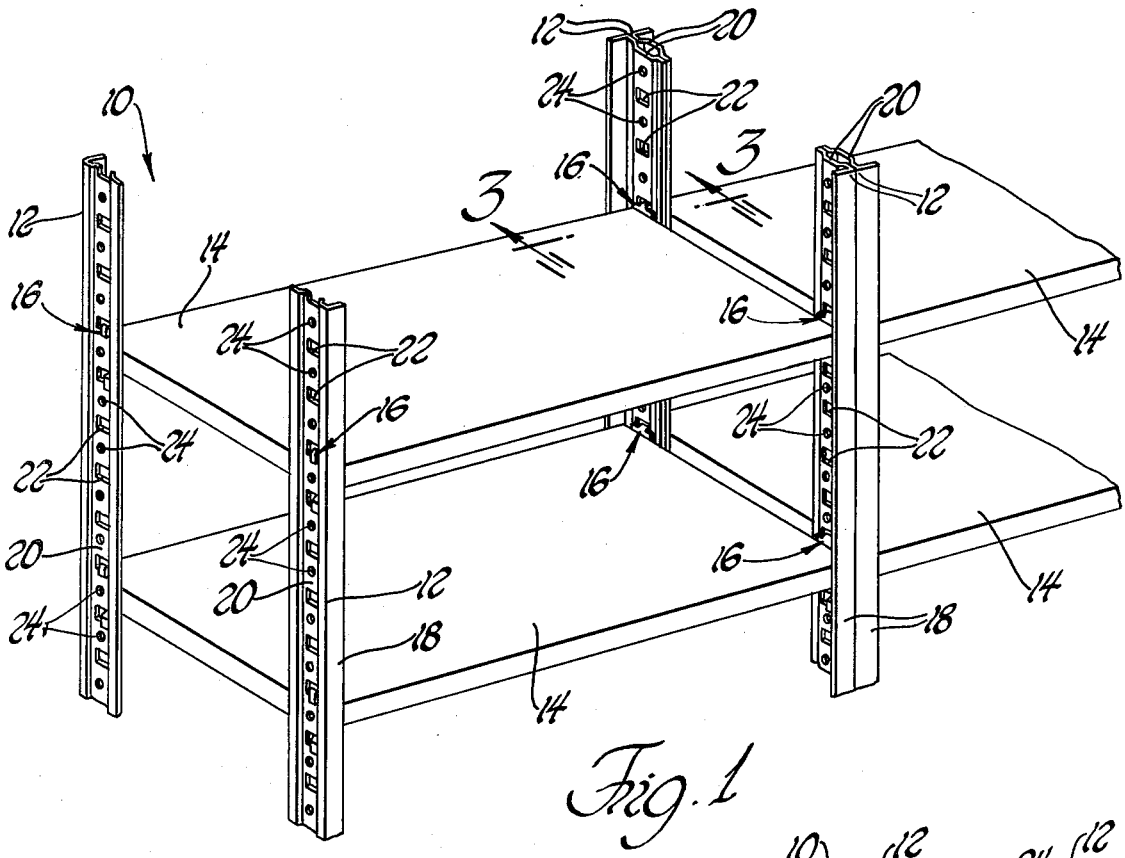
FIG. 1 is a perspective view of a shelving unit incorporating shelf clips according to the present invention.
Figure 2:
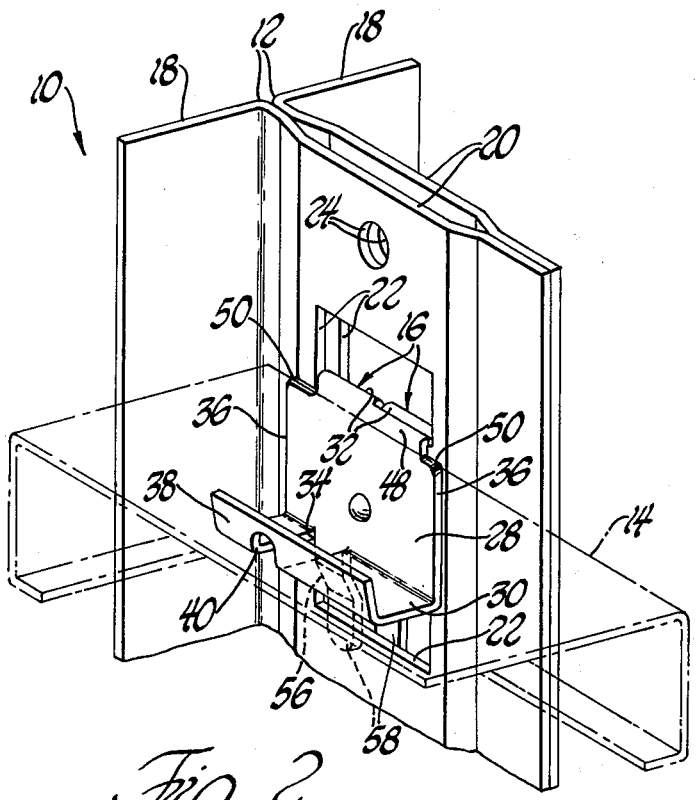
FIG. 2 is an enlarged perspective view of a portion of FIG. 1 with a shelf thereon shown in phantom line indication so as to more clearly show the shelf clip construction.

Referring to FIG. 1, a shelving unit indicated generally by 10 includes vertical columns 12 on which shelves 14 are supported at each of their corners by clips 16 constructed according to the present invention. Each column 12 has a somewhat L-shaped cross section including a face flange 18 and a securement flange 20, see also FIGS. 2 and 3. Formations of the securement flanges 20 on the column, as best seen in FIG. 2, space these flanges from each other at their intermediate portions so that the clips 16 can be secured to the columns within vertically spaced mounting openings 22 in a manner that is subsequently described. Holes 24 are formed in the column flanges 20 in an alternating relationship with the mounting openings 22 and at various locations nut and bolt connections 26 (FIG. 3) through the holes secure the columns to each other.

Each shelf clip 16 is stamped from a steel blank 26 (FIG. 4) that forms a unitary body of the clip. Stamping of the blank forms the clip to include a vertically extending attachment flange 28 and a horizontally extending support flange 30, see FIGS. 2 and 5-7. Upper and lower ends of the attachment flange 28 respectively include an upper support hook 32 and a lower positioning tang 34 that are received within associated shelving column mounting openings 22 (FIGS. 2 and 3) in order to secure the shelf clip to the associated column.

Figure 3:
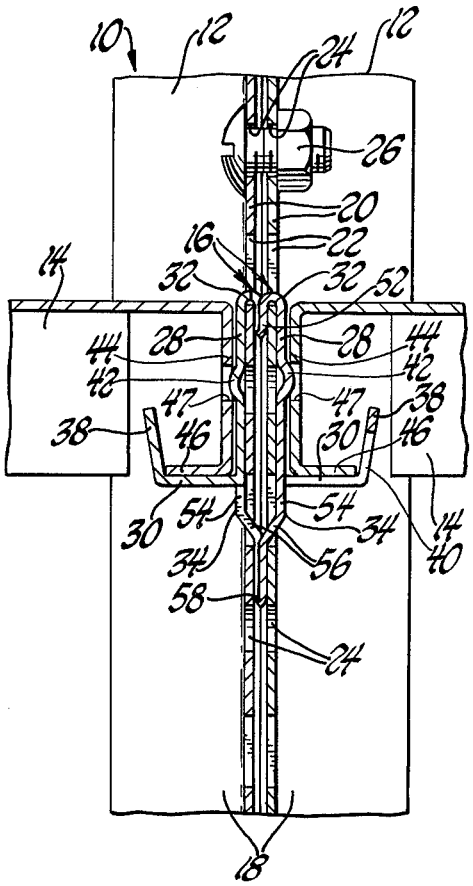
FIG. 3 is a sectional view taken along line 3—3 of FIG. 1 showing the manner in which shelf clips of this invention are utilized in a back-to-back interfitted relationship.
Figure 4:
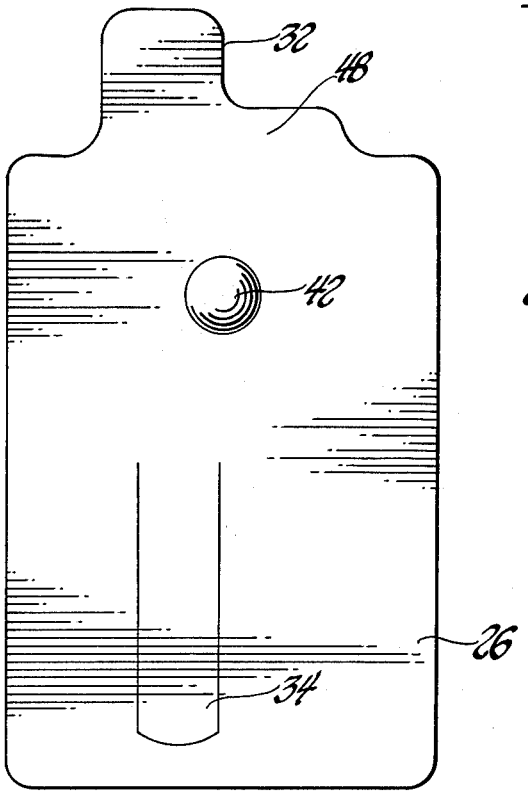
FIG. 4 is a view showing a metallic blank from which the shelf clip is stamped.
Figure 5:
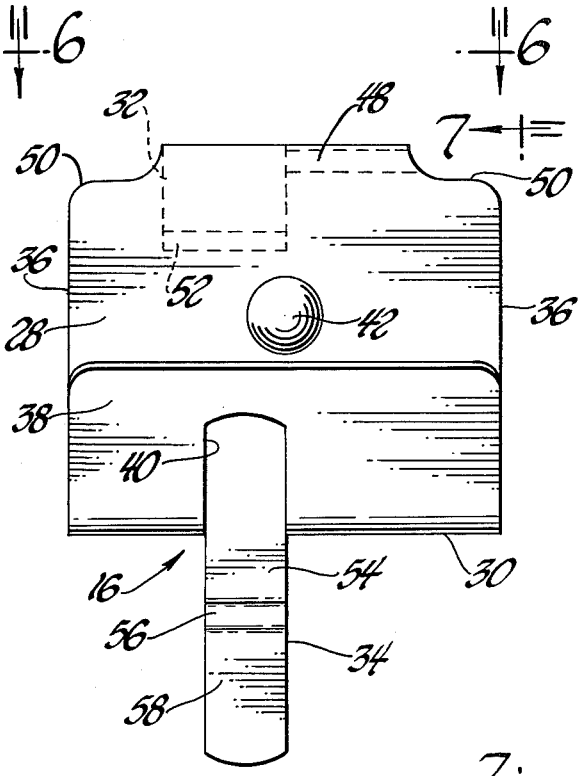
FIG. 5 is a front view of the shelf clip.
Figure 6:
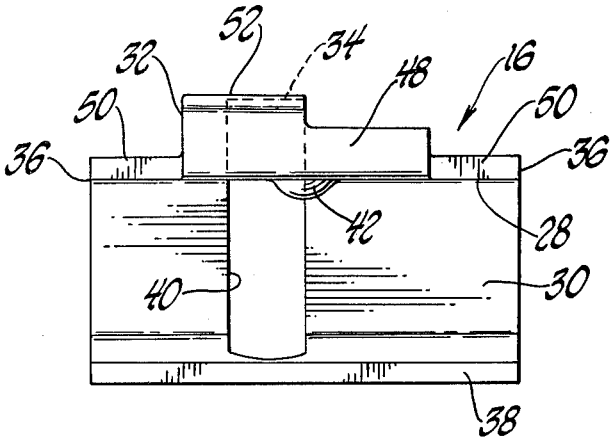
FIG. 6 is a top view of the shelf clip taken along line 6—6 of FIG. 5.

Support hook 32 and positioning tang 34 of the attachment flange 28 are each located to one side of the lateral center between the edges 36 that form the lateral sides of the attachment flange as best shown in FIG. 5. This construction allows two clips to be interfitted in a back-to-back relationship as best shown in FIGS. 2 and 3 during securement to adjacent shelving columns and to also securely position the clips with respect to the columns. While it would be possible for the clips to be interfitted with each other with the support hook 32 and the positioning tang 34 of each located on the opposite sides of the center, such a construction would not provide as secure an attachment of the clip to the shelving column due to the fact that loading would be resisted in an unsymmetrical vertical manner.

Figure 7:
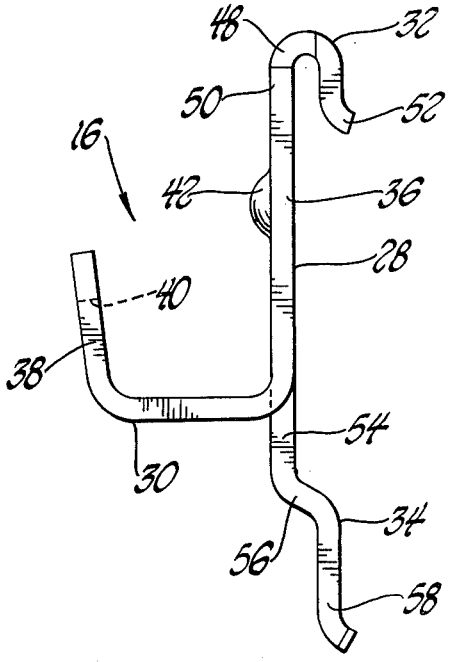
FIG. 7 is a side view of the shelf clip taken along line 7—7 of FIG. 5.

Support flange 30 extends horizontally away from the attachment flange 28 as best seen in FIGS. 2, 3, and 7 and has an outer end 38 that is bent upwardly and to extend away from the attachment flange with a slightly inclined orientation. Positioning tang 34 is struck from the support flange 30 and its end 38 prior to the stamp bending thereof such that an opening 40 remains within the resultant support flange and its end. A dimple 42 is stamped in the attachment flange 28 just above the vertical center of its height and at a location just above the upper extremity of the support flange end 38. Outward projection of the dimple 42 toward the support flange end 38 permits a cooperable action therebetween to secure the end of the associated shelf 14 in the manner best shown in FIG. 3. A downwardly bent flange 44 on each end of shelf 14 and a reversely bent horizontal flange 46 thereof are securely positioned by the shelf clip upon downward movement of the shelf over the clip in its secured position to the column. Vertical flange 44 of the shelf has an opening 47 that receives the dimple 42 with a snap action while horizontal flange 46 has its end engaged with the inclined end 38 of the clip support flange so that the shelf end is wedged in a secured relationship with respect to the clip once the horizontal flange of the shelf has been moved downwardly to the position shown.

As best shown in FIGS. 3 and 7, both the support hook 32 and the positioning tang 34 extend horizontally away from the attachment flange 28 of the clip in an opposite direction to the horizontally extending support flange 30. Support hook 32 is connected to the attachment flange 28 by a support section 48 that is symmetrical with respect to the opposite lateral edges 36 of the attachment flange such that its upper end defines shoulders 50 best seen in FIG. 5. A lower end 52 of the support hook 32 curves away from the attachment flange 36 as best seen in FIG. 7 to provide a somewhat curved ramp structure that receives the associated column securement flange 20 during downward movement of the clip to the mounted position shown in FIG. 3. Positioning tang 34 like the support hook also has a support section 54 that extends downwardly from the lower end of the attachment flange 28. An inclined portion 56 of the positioning tang 34 extends downwardly from the support section 54 and horizontally from the attachment flange 28 in the opposite direction as the shelf support flange 30. An end 58 of the positioning tang extends downwardly from the inclined portion 56 and has a curved shape extending away from the attachment flange 28 to provide a ramp construction like the end 52 of the support hook 32 in order to facilitate mounting of the clip to a support column upon downward clip movement.

While the clips 16 of this invention securely position shelves with respect to the shelving columns 12, firm manual pressure applied to the clips in an upward direction permits them to be detached for mounting at a different vertical position so that adjustability of the shelf location is permitted. Relatively firm manual pressure must be applied to position the clips in their mounted condition on the column since there is a relatively snug fit of the column flanges 20 between the attachment flange 28 and both the support hook 32 and the positioning tang 34. Also, while the clips may be interfitted in their back-to-back relationship as shown to support adjacent shelves 14 at the same height, vertical spacing of one clip with respect to an adjacent clip is also possible to support adjacent shelves at different elevations from each other.

In its preferred embodiment shown, shelf clip 16 has its attachment flange 28 formed with a vertical height of about one and one-quarter inches and a lateral width of about one and three-eighths inches. Support flanges 30 project horizontally from the attachment flange 28 for about three-quarters of an inch and its end 38 has an upwardly projecting height of about one-half inch. Support hook 30 extends downwardly about one-quarter of an inch and the positioning tang 34 extends downwardly about three-quarters of an inch. Both the support hook 32 and the positioning tang 34 have a width of one-quarter inch and project horizontally from the attachment flange 28 for a total horizontal extent of about three-sixteenths of an inch and are aligned with each other when viewed in a plan direction.

While a preferred embodiment of the shelf clip has herein been described, those skilled in the art will recognize various alternative designs and embodiments for practicing the present invention as defined by the following claims.

What is claimed is:

1. A shelf clip comprising a clip body having a vertically extending attachment flange with opposite lateral sides and upper and lower ends, a support flange extending horizontally from the lower end of the attachment flange to support a shelf thereon, a lower positioning tang at the lower end of the attachment flange to one side or the other of the center between the lateral sides thereof, said positioning tang being struck from the support flange so as to extend downwardly from the attachment flange and horizontally therefrom in the opposite direction as the shelf support flange, and an upper support hook at the upper end of the attachment flange located to one side or the other of the center between the opposite lateral sides of the attachment flange.

2. A shelf clip comprising a unitary metallic clip body having a vertically extending attachment flange of a plate-like construction with opposite lateral sides and upper and lower ends, a support flange extending horizontally from the lower end of the attachment flange to support a shelf thereon, a lower positioning tang struck from the support flange on one side of the center between the lateral sides of the attachment flange, said positioning tang having a support section extending downwardly from the lower end of the attachment flange in the plane thereof, the positioning tang having an inclined portion extending downwardly from the support section and horizontally therefrom in the opposite direction as the support flange, the positioning tang also having an end projecting downwardly from the inclined portion, and an upper support hook at the upper end of the attachment flange located on said one side of the center between the lateral sides of the attachment flange.

3. A shelf clip comprising a unitary metallic clip body having a vertically extending attachment flange of a plate-like construction with opposite lateral sides and upper and lower ends, a dimple formed in the attachment flange projecting horizontally therefrom, a support flange extending horizontally in the same direction as the dimple from the lower end of the attachment flange to support a shelf thereon, the support flange having an upwardly bent end that is cooperable with the dimple in the attachment flange to position a flanged shelf end therebetween, a lower positioning tang struck from the support flange on one side of the center between the lateral sides of the attachment flange, said positioning tang having a support section extending downwardly from the lower end of the attachment flange in the plane thereof, the positioning tang having an inclined portion extending downwardly from the support section and horizontally therefrom in the opposite direction as the shelf support flange, and an upper support hook at the upper end of the attachment flange located on said one side of the center between the lateral sides of the attachment flange.

4. A shelf clip comprising a unitary metallic clip body having a vertically extending attachment flange of a plate-like construction with opposite lateral sides and upper and lower ends, a dimple formed in the attachment flange projecting horizontally therefrom, a support flange extending horizontally in the same direction as the dimple from the lower end of the attachment flange to support a shelf thereon, the support flange having an end bent upwardly and inclined slightly to extend away from the dimple in the attachment flange so as to be cooperable therewith to position a flanged shelf end therebetween, a lower positioning tang struck from the support flange on one side of the center between the lateral sides of the attachment flange, said positioning tang having a support section extending downwardly from the lower end of the attachment flange in the plane thereof, the positioning tang having an inclined portion extending downwardly from the support section and horizontally therefrom in the opposite direction as the support flange, the positioning tang having an end projecting downwardly from the inclined portion, and an upper support hook at the upper end of the attachment flange located on said one side of the center between the lateral sides of the attachment flange in alignment with the end of the positioning flange.

5. A shelf clip comprising a unitary metallic clip body having a vertically extending attachment flange with opposite lateral sides and upper and lower ends, said attachment flange having a width of about one and three-eighths inches between the lateral sides thereof and a height of about one and one-quarter inches between the upper and lower ends thereof, a dimple formed in the attachment flange projecting horizontally therefrom, a support flange extending horizontally in the same direction as the dimple from the lower end of the attachment flange for about three-quarters of an inch to support a shelf thereon, the support flange having an end bent upwardly with a height of about one-half inch and inclined slightly so as to extend away from the dimple in the attachment flange to thereby be cooperable therewith to position a flanged shelf end therebetween, a lower positioning tang struck from the support flange on one side of the center between the lateral sides of the attachment flange, said positioning tang having a width of about one-quarter inch and extending downwardly about three-quarters of an inch from the lower end of the attachment flange, the positioning tang having an inclined portion extending downwardly and horizontally in the opposite direction as the support flange and also having a curved lower end projecting downwardly from the inclined portion and curving away from the attachment flange, and an upper support hook at the upper end of the attachment flange located on said one side of the center between the lateral sides of the attachment flange in alignment with the end of the positioning flange, said support hook having a curved lower end extending away from the attachment flange in the same direction as the lower end of the positioning tang.

* * * * *